US006776112B2

(12) United States Patent
Bruehl et al.

(10) Patent No.: US 6,776,112 B2
(45) Date of Patent: Aug. 17, 2004

(54) SEWING MACHINE COMPRISING A DEVICE FOR STEERING TOWARDS THE END OF A SEAM

(75) Inventors: Lothar Bruehl, Otterbach (DE); Edgar Butzen, Landstuhl (DE); Karl-Ludwig Manuel, Otterbach (DE)

(73) Assignee: G.M. PFAFF Aktiengesellschaft in Insolvenz, Kaiserslautern (DE)

( * ) Notice: Subject to any disclaimer, the term of this patent is extended or adjusted under 35 U.S.C. 154(b) by 0 days.

(21) Appl. No.: 10/297,111

(22) PCT Filed: May 23, 2001

(86) PCT No.: PCT/EP01/05906

§ 371 (c)(1),
(2), (4) Date: Jun. 2, 2003

(87) PCT Pub. No.: WO01/92628

PCT Pub. Date: Dec. 6, 2001

(65) Prior Publication Data

US 2004/0099191 A1 May 27, 2004

(30) Foreign Application Priority Data

May 29, 2000 (DE) ..... 100 28 273

(51) Int. Cl.[7] ..... D05B 19/16; D05B 27/22

(52) U.S. Cl. ..... 112/470.01; 112/275; 112/315

(58) Field of Search ..... 112/470.01, 275, 112/272, 315, 316, 317, 314, 471.01, 470.03, 277

(56) References Cited

U.S. PATENT DOCUMENTS

| | | | | |
|---|---|---|---|---|
| 4,528,923 A | | 7/1985 | Hager | |
| 4,587,915 A | | 5/1986 | Wenz et al. | |
| 4,722,291 A | * | 2/1988 | Goto | 112/470.03 |
| 4,732,095 A | * | 3/1988 | Saito et al. | 112/470.02 |
| 4,794,875 A | * | 1/1989 | Noguchi et al. | 112/470.03 |

FOREIGN PATENT DOCUMENTS

| | | |
|---|---|---|
| DE | 33 42 391 C1 | 3/1985 |
| DE | 33 24 715 C2 | 6/1988 |

* cited by examiner

*Primary Examiner*—Peter Nerbun
(74) *Attorney, Agent, or Firm*—McGlew and Tuttle, P.C.

(57) ABSTRACT

A sewing machine has a device for steering towards a predetermined end (E) of a seam (B1). An alternating movement of the feed elements of the sewing machine, which occurs when the stitch adjusting device is set, is taken into consideration in the calculation of the target stitch length (Sb) of the final optionally shortened end stitch (Nre) of the seam, in such a way that the setting value that deviates from the target stitch length is produced.

6 Claims, 2 Drawing Sheets

SEWING MACHINE COMPRISING A DEVICE FOR STEERING TOWARDS THE END OF A SEAM

FIELD OF THE INVENTION

The present invention pertains to a sewing machine with a needle bar driven in an upwardly and downwardly movable manner with a needle feed mechanism, a feed dog and the needle driven oscillatingly in the direction of feed, a stitch regulating device associated with the feed mechanism, and a device for controlling the sewing machine and for approaching a predetermined end point of a seam at a spaced location from the edge of a workpiece, the device comprises a sensor, which is arranged in front of the needle and triggers the operation for positioning the needle at the seam end point during the passage of the workpiece edge, the device has a pulse generator determining the speed of rotation and the angular position of a machine shaft and a computer, which controls the number of residual seam stitches and, via an adjusting device, the setting of the stitch regulating device for reaching the seam end point as a function of the distance between the needle and the sensor and the angular position of the machine shaft, which is determined at the time of the edge recognition.

BACKGROUND OF THE INVENTION

A means for approaching the end point of a seam, in which this operation is triggered by means of a sensor scanning the passage of the workpiece edge extending at right angles or at an angle to the seam, is known from DE 33 24 715 C2 (U.S. Pat. No. 4,528,923) in a sewing machine with lower and needle feed. The means comprises, furthermore, a pulse generator detecting the speed of rotation and the angular position of a machine shaft, by which the size of the partial stitch already pushed during the edge recognition is determined. The number of residual seam stitches, which are unchanged in length, and the length of the shortened end stitch or the length of a plurality of uniformly shortened residual seam stitches are calculated by means of a computer as a function of the distance between the middle position of the needle of the sewing machine and the sensor, the seam distance and the length of the partial stitch yet to be pushed.

To adjust the stitch regulating device accurately and also comparatively rapidly, the computer prompts the presetting of a stop for limiting the movement stop of a follower member coupled with the stitch regulating device. This follower member is moved very rapidly against the stop before the beginning of the one shortened end stitch or of the first of several shortened residual seam stitches by means of a compressed air cylinder and the stitch regulating device is thus adjusted to the desired shortened stitch length.

It is expressly emphasized in the DE-C2 that the adjustment of the stitch regulating device takes place during the short time available during the phase of standstill between the needle and the workpiece. This should be understood to mean that the exact adjustment of the stitch regulating device can take place only in the middle of the phase of feed of the feed dog and the needle and consequently with the lower needle feed.

The same situation that was described in the specification of the DE-C2 concerning the sewing unit for sewing calender envelopes of the firm of Adler would otherwise occur. A sewing machine with lower feed is used in this prior-art sewing unit. When the stitch regulating device is set to the stitch length zero in this unit during the feed motion in order to interrupt the feed motion of the workpiece as a result, this can be performed with sufficient accuracy only if the feed dog has performed exactly half of its feed motion during the adjustment of the stitch regulating device and is therefore in the middle of the needle. Because of the existing kinematics of stitch regulating devices, the feed dog always assumes the middle position during the adjustment of the stitch regulating device to zero. If the adjustment of the stitch regulating device is performed before or after the middle position of the feed dog, the latter will therefore perform a forwardly or backwardly directed offset movement toward the middle of the needle. Since this happens while a feed step is being performed, during which the feed dog is in contact with the workpiece, the workpiece also performs the offset movement of the feed dog, and this movement is therefore also called pushing movement.

Such an offset movement also occurs in the sewing machine with lower and needle feed known from the above-mentioned DE 33 24 715 C2 during the adjustment of the stitch regulating device. The effects of this on the stitch length of the sewing stitch to be performed thereafter are illustrated in the drawing on the basis of the movement of the needle, whose tip describes elliptical movement paths.

FIG. 4 shows the movement path of the needle 5 during a feed cycle, during which the stitch regulating device is set to the stitch length S and the needle 5 feeds the workpiece W together with the feed dog 9 by the amount of the set stitch length S in the direction of feed V. The movement path of the needle 5 is now symmetrical to the middle of the needle Nm.

FIG. 5 shows the situation that would occur if the stitch length Sb of a residual seam end stitch located at the end point of the seam were detected by means of the computer after an edge recognition and the stitch regulating device were set to the stitch length Sb during the return phase of the needle and the feed dog. After the completion of the last feed cycle, the last point of insertion of the needle 5 or the point at which the needle exits is located at a distance S/2 in the direction of feed V behind the middle of the needle Nm. If the stitch regulating device is set to the lower value Sb, the needle bar first performs an offset movement in the direction of the middle of the needle because of the above-mentioned existing kinematics of stitch regulating devices. The needle bar then moves in front of the middle of the needle Nm by the amount Sb/2 when viewed in the direction of feed V. A stitch length of Sz=S/2+Sb/2 is thus obtained for the next sewing stitch. If, e.g., the stitch length is S=4 mm and a stitch length of Sb=1 mm was calculated for the residual seam end stitch, a stitch length of Sz=4/2+1/2=2.5 mm would be obtained for the last stitch. The last stitch would thus be too long by 1.5 mm.

To avoid such an offset movement leading to an unusable result, the adjusting movement of the stitch regulating device must be, as was mentioned, very rapid, i.e., sudden in the middle of the feed phase. However, the consequence of this is that the adjustment operation causes a vibration of the sewing machine and a corresponding noise. If, by contrast, the adjustment operation shall take place more slowly, the sewing machine would have to be briefly stopped for this purpose, which would interrupt the sewing operation and lead to a loss of time.

These problems are avoided in the means known from DE 33 42 391 C1 (U.S. Pat. No. 4,587,915) such that the setting of the stitch regulating device remains unchanged in this means for the performance of a single shortened end stitch or a plurality of shortened residual seam stitches, and the feed dog is raised, instead, during its return phase, which normally takes place in the lowered position, until it pushes the workpiece back against the normal direction of feed by the amount by which the next end stitch or residual seam stitch shall be shortened. Aside from the fact that this means is technically highly complicated, another drawback lies in the fact that it may sometimes lead to inaccurate results because the feed dog, which now acts as the only feed means, is operating against the normal direction of feed of its teeth during the reverse push, and a slip, whose amount depends very strongly on the properties of the particular fabric of the workpiece, may therefore develop between the feed dog and the workpiece.

SUMMARY OF THE INVENTION

The basic object of the present invention is to provide a sewing machine with a means for approaching a predetermined end point of a seam, which has a simple design and in which the adjustment of the stitch regulating device can be carried out without interruption of the sewing operation.

The present invention is based essentially on the idea of adjusting the stitch regulating device during the phase of return of the feed means before the sewing of a shortened end stitch or residual seam stitch such that the offset path of the feed means, which thus arises, is also taken into account, so that the end stitch of the seam is carried out with the necessary stitch length and the seam is terminated precisely at the point predetermined by the amount of the particular seam distance.

The process is also suitable for sewing uniformly shortened residual seam stitches. However, the particular offset path, which is consequently the current offset path, must be taken into account in this case for sewing every individual residual seam stitch, and the stitch regulating device must be set separately for every individual residual seam stitch.

The law that is equally applicable to both types of seam end management, by which the amount of the offset path is taken into account without having to determine it directly, is described.

The adjusting device for the stitch regulating device is formed by a stepping motor. This design of the adjusting means, which is simple compared with the state of the art, is made possible by the fact that by taking into account the offset path of the feed means, which arises during the adjustment of the stitch regulating device, the adjustment operation does not need to take place abruptly, but it can be performed during the comparatively long time of the return phase of the feed means.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
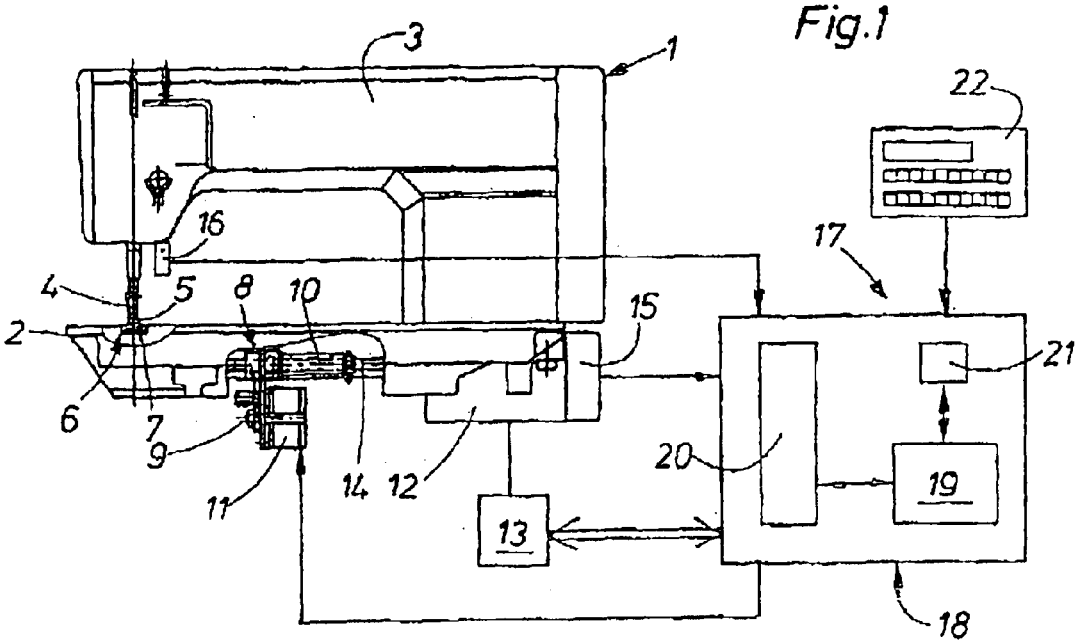
FIG. 1 is a view of a sewing machine with a schematic block diagram of the control means.

Referring to the drawings in particular, in the sewing machine 1, the base plate is designated by 2 and the upper housing by 3. A needle bar 4, which can be moved up and down, is arranged with a needle 5 in the head of the upper housing 3. A hook shuttle, not shown, cooperates with the needle 5 in the known manner.

The feed mechanism 6 of the sewing machine 1 is designed as a lower and needle feed, as in the sewing machine according to DE 33 24 715 C2 mentioned in the introduction, and it therefore comprises a feed dog 7 arranged in the base plate 2 and the needle 5. The needle bar 4 is accommodated for this purpose in the known manner in a needle bar pendulum, which is not shown in the drawings. The feed dog 7 and the needle bar pendulum are connected to a drive mechanism, which is partially coupled with one another, and which corresponds to the drive mechanism disclosed in the DE-C2 and therefore will not be shown and described here once again.

A common stitch regulating device 8 is used to set the amount of feed of the feed mechanism 6. It has a first adjusting mechanism 9 shown schematically in FIG. 1 for the feed dog 7, and this mechanism 9 corresponds to the adjusting mechanism 26 in the above-mentioned DE-C2. The stitch regulating device 8 has a second adjusting mechanism, not shown, for the needle 5, which comparably corresponds to the adjusting mechanism 44 in the DE-C2.

An adjusting shaft 10, which is connected to the adjusting shaft of the second adjusting mechanism in the usual manner via coupling members, is associated with the adjusting mechanism 9, so that the two adjusting mechanisms always have the same setting value and are always set to the same stitch length. The adjusting shaft 10 is connected to a stepping motor 11. Due to the two adjusting mechanisms being coupled, the stepping motor 11 is used for both and there is, on the whole, a common adjusting means for the stitch regulating device 8.

A positioning motor 12 arranged in the base plate 2 with a control 13 is used to drive the sewing machine 1. The positioning motor 12 drives, among other things a drive shaft 14 for the feed dog 7 in a manner not shown more specifically. A pulse generator 15 is arranged at the positioning motor 12, the pulse generator 15 being used to determine the speed of rotation of the sewing machine 1 and the angular position of the drive shaft 14 when an edge K2 of a workpiece W passes through the light beam of a photoelectric cell, of which only a sensor 16 arranged at the head of the upper housing 3 is shown.

A control means 17, which contains a computer 18, is associated with the sewing machine 1. The computer 18 comprises essentially a processor 19, an I/O member 20 and at least one EPROM 21. The control means 17 contains, furthermore, an operating element 22 connected to the computer 18.

The mode of operation is as follows:

The scanning point A of the sensor 16 is located at a distance L from the middle position M of the needle 5. During the preparation of a seam B1 consisting of sewing stitches N of a stitch length S at a distance a from the edge K1 of a workpiece W, the sensor 16 reports the passage of the edge K2 of the workpiece W through the scanning point A.

The size Sa of the partial stitch not yet completed at the time of the recognition of the edge, which is to be taken into account subsequently during the residual seam extending over the length 1, is determined by means of the computer 18 in the same manner as described in the above-mentioned DE 33 24 715 C2.

Figure 2:
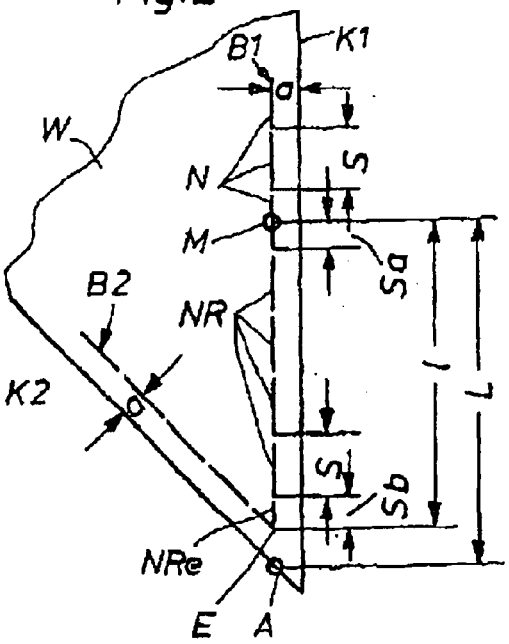
FIG. 2 is a schematic view of a seam section with a shortened residual seam end stitch.

In the case of the manner of seam end management shown in FIG. 2, in which the partial stitch yet to be pushed is taken into account only during the residual seam stitch NRe, the number of residual seam stitches NR to be formed with unchanged stitch length S and the length Sb of the residual seam end stitch NRe are now calculated by the computer 18 as a function of the residual seam length 1 and the stitch length S set originally.

The length Sb of the residual seam end stitch NRe now forms the desired stitch length necessary for ending the seam B1 exactly at point E. To compensate the offset path of the feed dog 7 and the needle 5, which arises during the adjustment of the stitch regulating device 8, the computer 18 calculates from this, moreover, the value Sen to be actually set according to the formula $$Sen=2\times Sb-Sea.$$

Here,

Sen=new stitch length to be set

Sb=necessary desired stitch length for the residual seam end stitch NRe

Sea=old stitch length set; this corresponds to the original stitch length S in this seam end variant.

Calculation Example:

$$S=Sea=4\text{ mm}$$

$$Sb=1\text{ mm}$$

$$Sen=2\times 1\text{ mm}-4=-2\text{ mm}.$$

This means that the stitch regulating device 8 must be set to the value −2 mm, i.e., to a reverse stitch of 2 mm, by means of the stepping motor 11 during the return phase of the feed means 5, 7. If this has thus happened, the feed mechanism 6 performs a forwardly directed feed motion over a length of 1 mm to form the residual seam end stitch NRe, as it corresponds to the necessary desired stitch length Sb.

Figure 6:
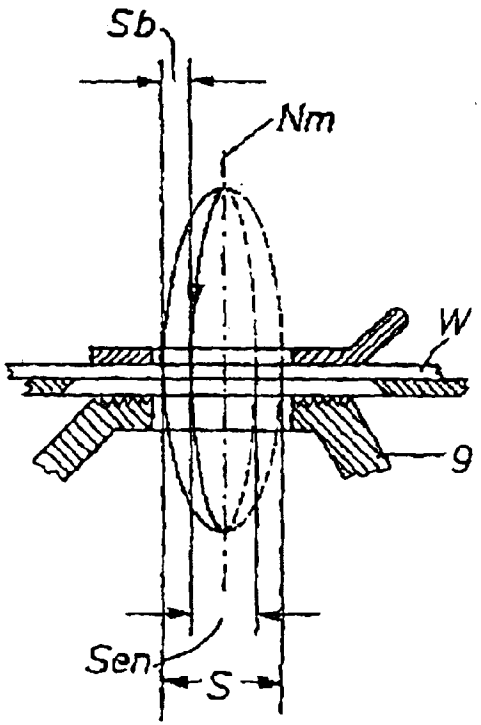
FIG. 6 is the movement path of the needle after the adjustment of the stitch regulating device with the compensation of the offset movement, which compensation is performed in the process.

FIG. 6 shows this situation on the basis of the movement path of the needle 5. After completion of the feed cycle of the last residual seam stitch NR with the stitch length S=4, the point at which the needle exits is located at a distance of S/2=2 mm behind the middle of the needle Nm. If the stitch length Sen=−2 mm is set, the needle bar 4 remains in the area behind the middle of the needle Nm because of the reverse feed to be set, and a new point of insertion, which is located −2/2=−1 mm behind the middle of the needle, arises for the needle 5. It follows from this that the residual seam end stitch NRe is indeed formed with a stitch length of 1 mm.

Figure 5:
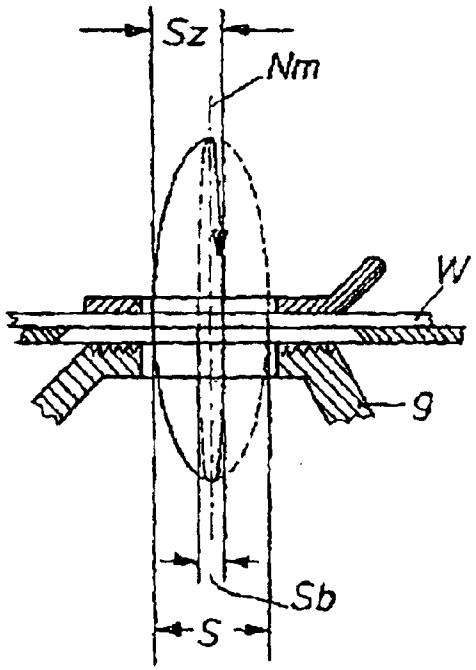
FIG. 5 is the movement path of the needle after the adjustment of the stitch regulating device with the effect of the offset movement occurring during the adjustment.
Figure 4:
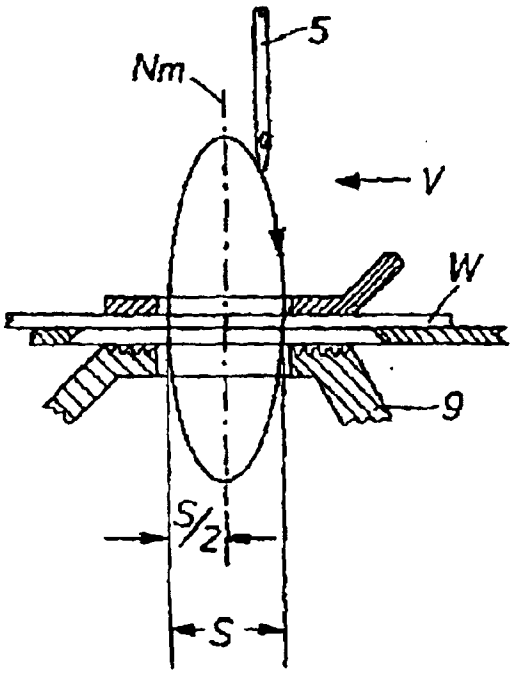
FIG. 4 is the movement path of the needle during the performance of a feed cycle.

The offset movement of the feed dog 7 and the needle 5, which arises during the adjustment of the stitch regulating device 8 taking place during the return phase of the feed dog 7 and of the needle 5, is thus compensated. If this compensation of the offset movement did not take place and the stitch regulating device 8 were set at the value of the desired stitch length of 1 mm, an effective stitch length of 2.5 mm would be obtained for the residual seam end stitch NRe, as is shown in FIG. 5, as a consequence of which the actual end point of the seam would be beyond the desired end point E by 1.5 mm.

If the first sewing stitch of the second seam B2 along the workpiece edge K2 is to have the same length as the residual seam end stitch NRe to obtain a symmetrical design of a seam corner area, the stitch regulating device 8 must be set to the value $$Sen=2\times Sb-Sea$$

$$=2\times 1\text{ mm}-(-2\text{ mm})$$

$$=4\text{ mm}.$$

This value corresponds to the normal stitch length S. Consequently, while the first sewing stitch of the second seam has reached the desired length of 1 mm, the second sewing stitch and all further sewing stitches are formed with the normal stitch length 4 mm while the setting of the stitch regulating device 8 now remains unchanged.

Figure 3:
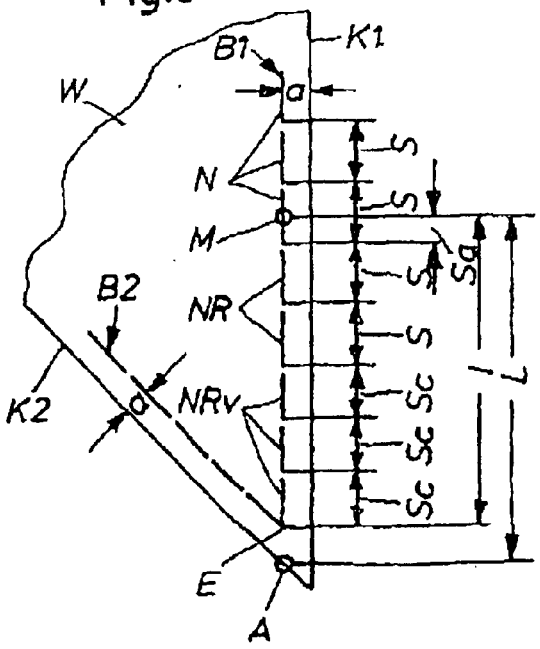
FIG. 3 is a schematic view of a seam section with a plurality of uniformly shortened residual seam stitches.

To perform the type of seam end management shown in FIG. 3, in which the partial stitch yet to be pushed is taken into account in the case of, e.g., three uniformly adapted residual seam stitches NRv, the computer 18 now calculates the number of residual seam stitches NR to be formed with unchanged stitch length S and the length Sc of the three shortened residual seam stitches NRv as a function of the residual stitch length 1 and the stitch length S set originally.

The length Sc of the residual seam stitches NRv forms here the desired stitch length of the last three residual seam stitches NRv that is necessary for ending the seam B1 exactly at point E. To compensate the offset path of the feed dog 7 and of the needle 5, which arises during the adjustment of the stitch regulating device 8, the computer 18 calculates, moreover, the value Sen to be actually set for every individual of the last three residual seam stitches NRv, doing so according to the formula $$Sen=2\times Sc-Sea.$$

This formula corresponds exactly in terms of its contents to the above-mentioned formula. The only difference is that the desired stitch length of the last three residual seam stitches NRv is called Sc in this formula, whereas the desired stitch length of the only residual seam stitch NRe was called Sb in the first-mentioned formula.

Calculation Example:

$$S=4\text{ mm}$$

$$Sc=3\text{ mm}.$$

First Shortened Residual Seam Stitch NRv $$Sen=2\times 3\text{ mm}-44\text{ mm}=2\text{ mm}$$

The original stitch length S=4 is to be used here for Sea.

Second Shortened Residual Seam Stitch NRv $$Sen=2\times 3\text{ mm}-2\text{ mm}=4\text{ mm}$$

The stitch length Sen=2 mm set before is to be used here for Sea.

Third Shortened Residual Seam Stitch NRv $$Sen=2\times 3\text{ mm}-4\text{ mm}=2\text{ mm}$$

The stitch length Sen=4 mm set before is to be used here for Sea.

It follows from this that the stitch regulating device 8 must be set separately for every individual residual seam stitch NRv for sewing a plurality of uniformly shortened residual seam stitches NRv in order to compensate the current offset path occurring in the particular case.

If the starting area of the second seam B2 shall look like the end area of the first seam B1 with this type of seam end management, and this seam therefore begins with three shortened sewing stitches of a length of 3 mm each, and the sewing of this seam is then to be continued with a stitch length of 4 mm, the stitch regulating device 8 must be set to the value Sen=4 mm for the first sewing stitch, to the value Sen=2 mm for the second sewing stitch and to the value Sen=4 mm for the third sewing stitch. Sewing can then be continued with the last setting value, because this value corresponds to the normal stitch length S=4 mm.

While specific embodiments of the invention have been shown and described in detail to illustrate the application of the principles of the invention, it will be understood that the invention may be embodied otherwise without departing from such principles.

What is claimed is:

1. A sewing machine comprising:

a needle bar driven in an upwardly and downwardly movable manner with a needle;

a feed mechanism with a feed dog and with said needle driven oscillatingly in a direction of feed;

a stitch regulating device associated with said feed mechanism;

control means for controlling the sewing machine and for approaching a predetermined end point of a seam at a spaced location from an edge of a workpiece W, said control means including a sensor arranged in front of said needle and triggering an operation for positioning said needle at a seam end point during the passage of a workpiece edge, a pulse generator determining the speed of rotation and the angular position of a machine shaft and a computer controlling a number of residual seam stitches and, via an adjusting device, the setting of said stitch regulating device for reaching said seam end point as a function of the distance between said needle and said sensor and the angular position of said machine shaft is determined at the time of the edge recognition and to obtain a desired stitch length of a residual seam end stitch, which is adapted in terms of length, said stitch regulating device is adjustable between the end of a feed phase of the preceding, yet unchanged residual seam stitch and the beginning of the feed phase of the residual seam end stitch, taking into account the current offset path of said feed dog and said needle, which arises during the adjustment of said stitch regulating device.

2. A sewing machine comprising:

a needle bar driven in an upwardly and downwardly movable manner with a needle;

a feed mechanism with a feed dog and with said needle driven oscillatingly in a direction of feed;

a stitch regulating device associated with said feed mechanism;

control means for controlling the sewing machine and for approaching a predetermined end point of a seam at a spaced location from an edge of a workpiece W, said control means including a sensor arranged in front of said needle and triggering an operation for positioning said needle at a seam end point during the passage of a workpiece edge, a pulse generator determining the speed of rotation and the angular position of a machine shaft and a computer controlling a number of residual seam stitches and, via an adjusting device, the setting of said stitch regulating device for reaching said seam end point as a function of the distance between said needle and said sensor and the angular position of said machine shaft is determined at the time of the edge recognition and to obtain the desired stitch length of a plurality of residual seam stitches, which are adapted in terms of length, said stitch regulating device is adjustable for every individual of said residual seam stitches to be adapted between an end of a feed phase of said preceding residual seam stitch and the beginning of the feed phase of a subsequent residual seam stitch, taking into account the current offset path of said feed dog and said needle, which arises during the adjustment of said stitch regulating device.

3. A sewing machine in accordance with claim 1, wherein the adjustment of said stitch regulating device, which is to be performed to form said residual seam end stitch adapted in terms of length or said residual seam stitches adapted in terms of length, is performed according to the following relationship:

new stitch length to be set is equal to two times the desired stitch length or the desired stitch length less the old stitch length set for the preceding sewing stitch.

4. A sewing machine in accordance with claim 1, wherein the adjusting means is formed by a stepping motor.

5. A sewing machine in accordance with claim 2, wherein the adjustment of said stitch regulating device, which is to be performed to form said residual seam end stitch adapted in terms of length or said residual seam stitches adapted in terms of length, is performed according to the following relationship:

new stitch length to be set is equal to two times the desired stitch length or the desired stitch length less the old stitch length set for the preceding sewing stitch.

6. A sewing machine comprising:

a needle bar driven in an upwardly and downwardly movable manner with a needle;

a feed mechanism with a feed dog and with said needle driven oscillatingly in a direction of feed;

a stitch regulating device associated with said feed mechanism;

control means for controlling the sewing machine and for approaching a predetermined end point of a seam at a spaced location from an edge of a workpiece W, said control means including a sensor arranged in front of said needle and triggering an operation for positioning said needle at a seam end point during the passage of a workpiece edge, a pulse generator determining the speed of rotation and the angular position of a machine shaft and a computer controlling a number of residual seam stitches and, via an adjusting device, the setting of said stitch regulating device for reaching said seam end point as a function of the distance between said needle and said sensor and the angular position of said machine shaft is determined at the time of the edge recognition and one of:

to obtain the desired stitch length (Sb) of a residual seam end stitch (NRe), which is adapted in terms of length, said stitch regulating device is adjustable between an end of a feed phase of the preceding, yet unchanged residual seam stitch (NR) and the beginning of the feed phase of the residual seam end stitch (NRe), taking into account the current offset path of said feed dog and said needle, which arises during the adjustment of said stitch regulating device, and to obtain a desired stitch length (Sc) of a plurality of said residual seam stitches (NRv), which are adapted in terms of length, said stitch regulating device is adjustable for every individual of said residual seam stitches (NRv) to be adapted between the end of the feed phase of the said preceding residual seam stitch NR or NRv and the beginning of the feed phase of the said subsequent residual seam stitch NRv, taking into account the current offset path of said feed dog and said needle, which arises during the adjustment of said stitch regulating device.

* * * * *